United States Patent [19]

Thebaud

[11] 4,325,577

[45] Apr. 20, 1982

[54] FOLDABLE CHAIR

[76] Inventor: Sacha Thebaud, P.O. Box 446, Port-Au-Prince, Haiti

[21] Appl. No.: 152,520

[22] Filed: May 22, 1980

[51] Int. Cl.[3] ..... A47C 4/28

[52] U.S. Cl. ..... 297/45; 297/441

[58] Field of Search ..... 297/45, 16, 19, 47, 297/441

[56] References Cited

U.S. PATENT DOCUMENTS

| | | | |
|---|---|---|---|
| 604,212 | 5/1898 | Palmer | 297/441 |
| 614,235 | 11/1898 | Palmer | 297/441 |
| 2,809,692 | 10/1957 | Taffae | 297/441 |

FOREIGN PATENT DOCUMENTS

| | | | |
|---|---|---|---|
| 958637 | 12/1974 | Canada | 297/441 |
| 1073121 | 9/1954 | France | 297/45 |
| 370542 | 8/1963 | Switzerland | 297/45 |

*Primary Examiner*—Roy D. Frazier
*Assistant Examiner*—Peter A. Aschenbrenner
*Attorney, Agent, or Firm*—Hauke and Patalidis

[57] ABSTRACT

A foldable chair comprising a seat portion made of a sheet of flexible material such as canvas, fabric, leather or plastic supported by a pair of rectangular support frames hinged relative to each other and crossing each other along an intermediary hinge line such as to form a figure X when supported from the ground and viewed from the front. The flexible seat portion is frictionally held at its ends as a result of being wrapped around and passed between a pair of parallel lateral tie members forming part of each support frame or, alternatively, forming part of an armrest in chair structures including a back supporting portion. The end flap of canvas, fabric, leather or plastic wrapped around and passed between the anchoring tie members is held in position between the surfaces in engagement and, in structure provided with a back portion, a length of pliable material is held in position in the same manner by having each end wrapped around and passed between support tie members formed integral with the chair armrest structures.

5 Claims, 12 Drawing Figures

FIG. 1
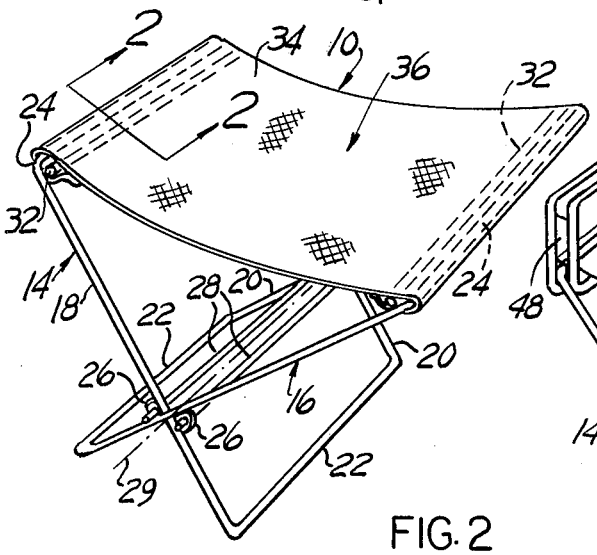
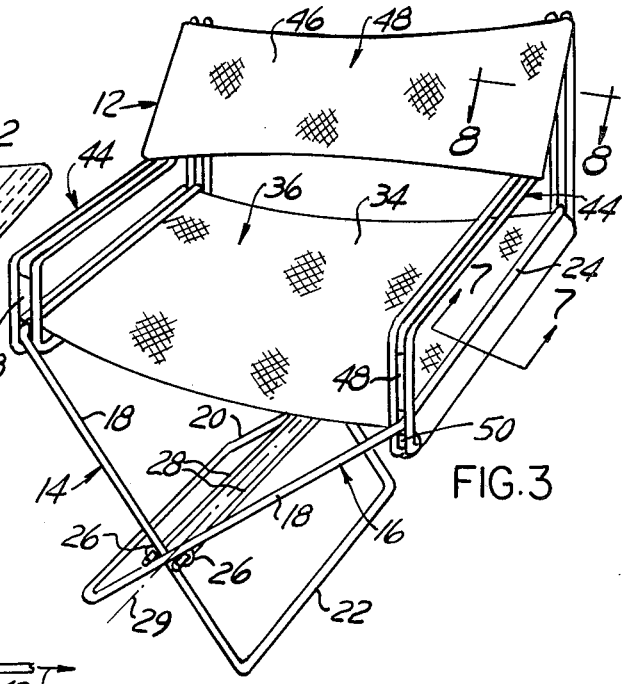
FIG. 3
FIG. 2
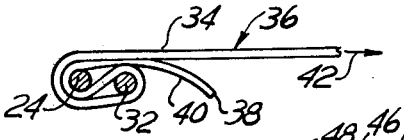
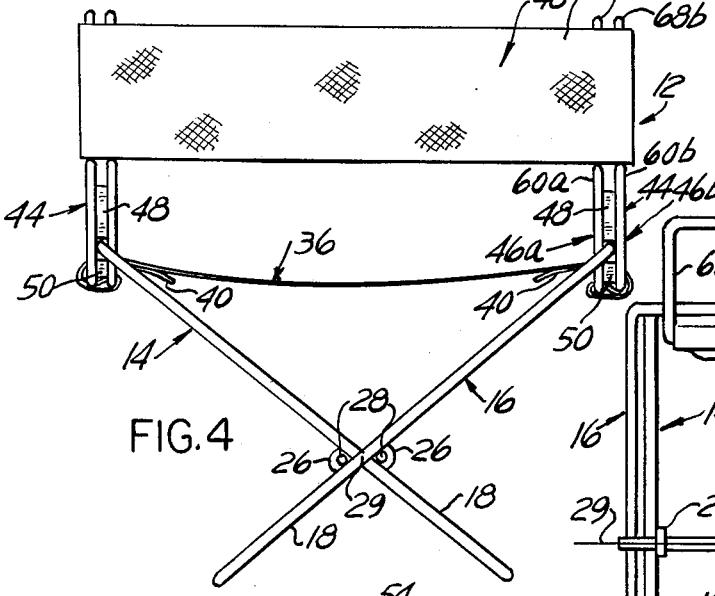
FIG. 4
FIG. 5
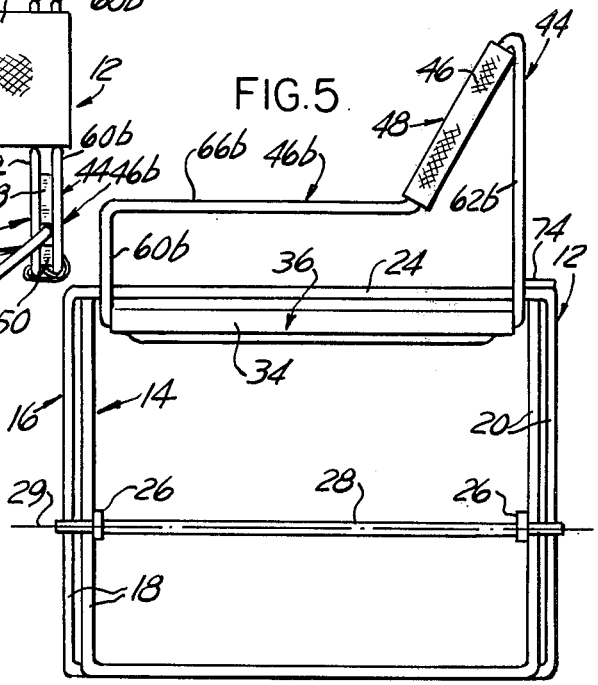
FIG. 7
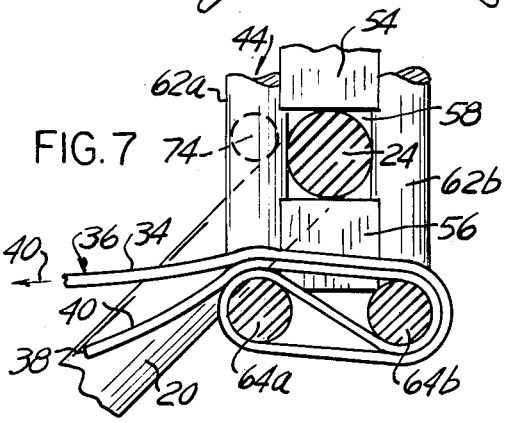
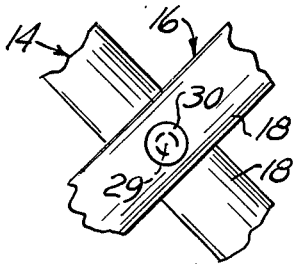
FIG. 6

FOLDABLE CHAIR

BACKGROUND OF THE INVENTION

The present invention relates to furniture and more particularly to body supporting foldable furniture, such as foldable chairs and the like.

A wide variety of foldable chairs have been designed in the past, which belongs to a category of foldable chairs generally designated as "director's chairs" or "captain's chairs". Such foldable chairs generally comprise two pairs of parallel legs, the front and rear legs of one pair being pivotally joined to the corresponding front and rear legs of the other pair at some mid-point between the ends of the legs, such as to form a figure X when viewed from the front or the rear, the legs of each pair being joined at their top by a longitudinally disposed lateral members to which is fastened each end of a length of pliable material, such as canvas, fabric, leather or plastic by way of laying each edge end of the length or sheet of pliable material in a groove in the lateral members and wedging the material in the groove or, alternatively by attaching the ends of the length or sheet of pliable material by lacing a string through apertures punched through the pliable material proximate its lateral edges, the string being wrapped around the lateral member. The back portion of the chair is also made of a length of the same material as the seat, provided at its end with a gusset for passage therethrough of a pair of parallel back supporting members. The frame structure of the chair is often made of wood bars or, more rarely, of metallic tubings such as steel or aluminum tubings.

SUMMARY OF THE INVENTION

The present invention provides a self-supporting structure for foldable chairs which is relatively simple and of low manufacturing cost, which is light and easy to carry when folded, and which can be made with any one of a variety of materials. The supporting surfaces, that is the surfaces supporting the seat and the back of a person sitting in the chair, are made of sheets of pliable material, such as canvas, fabric, leather, plastic, held and connected to the chair support frames at their ends by appropriate wrapping around and between parallel closely spaced anchoring elongated members, and rely on frictional interlayer action for attachment to the anchoring members, such that any stretch in the material can be easily taken up. In addition, the invention provides foldable chairs which, once erected, have a shape which is aesthetically pleasant.

These and other objects of the present invention will be apparent to those skilled in the art when the following description of examples of the best modes contemplated for practicing the invention is read in conjunction with the accompanying drawing wherein like numerals refer to like or equivalent elements and in which:

BRIEF DESCRIPTION OF THE DRAWING

FIG. 1 is a perspective view of a stool-like backless foldable chair according to the invention;

FIG. 2 is a partial sectional view along line 2—2 of FIG. 1;

FIG. 3 is a perspective view of a foldable full chair according to the present invention;

FIG. 4 is a front elevation view thereof;

FIG. 5 is a side elevation view thereof;

FIG. 6 is a partial front elevation of a modification thereof;

FIG. 7 is a partial sectional view along line 7—7 of FIG. 3;

DETAILED DESCRIPTION OF THE PREFERRED EMBODIMENTS

Figure 9:
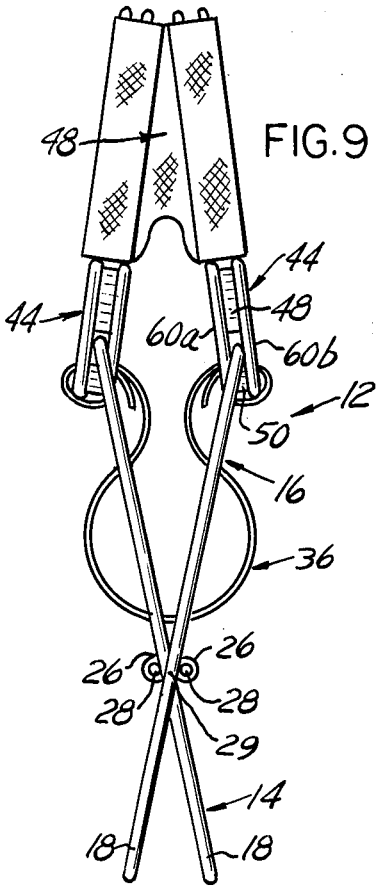
FIG. 9 is a front elevation view of the chairs of FIGS. 3—5 shown partially folded.

Referring to the drawing, and more particularly to FIG. 1, a foldable backless chair 10, or stool, according to the present invention comprises a pair of separate rectangular frames 14 and 16, each made of a closed straight sided loop of preferably metallic rod or tubing, such as iron, steel or aluminum rod or tubing, the abutting ends of the length of rod or tubing forming each frame being butt welded or brazed together. Each frame 14 or 16 thus defines a pair of substantially parallel leg portions 18 and 20, and a pair of substantially parallel normally horizontally disposed integral portions defining a foot member 22 normally supporting the stool 10 from the ground and a longitudinally extending lateral cross-member 24. The frames 14 and 16 are in planes crossing or intersecting each other along an intersecting or hinge line 29 intermediate between the ends of the leg portions 18 and 20, such as to be disposed relative to each other generally as a figure X when viewed from the front or the rear. In the structure illustrated, the leg portions 18 and 20 are each provided with a ring 26 welded, soldered or brazed thereto through which is disposed a longitudinally extending rod 28. Each of the rods 28 extends along and parallel to the plane of each of the frames 14 and 16, such that the rod 28 corresponding to the frame 14 abuts against the side of the leg portions 18 and 20 of the frame 16, and the rod member 28 corresponding to the frame 16 abuts against the side of the legs 18 and 20 of the frame member 14, thus providing the pivot axis or hinge line 29 between the two frame members 14 and 16 at the intersection between the planes of the frames permitting each frame to pivot relative to the other from a closed position for storage or transportation to an open position while supported from the ground as illustrated at FIG. 1. If so desired, the rods 28 may be interconnected by metallic rings, rubber rings or tape. Other means than the rods 28 may be used to provide pivoting of one frame relative to the other, such as bolts or rivets, as shown at 30 at FIG 6, passed through appropriate aperture drilled through the leg portions 18 and 20 at the desired pivot line.

An inner lateral elongated member 32, FIGS. 1–2, extending substantially proximate and parallel to each lateral cross-member 24 of each of the frames 14 and 16, is fastened by welding, soldering or brazing, or otherwise at each of its ends to the leg portion 18 and to the leg portion 20 of each frame such as to form, in co-operation with the lateral cross-member 24, a convenient means for anchoring the lateral edges of a length 34 of canvas, fabric, plastic or like material, defining a pliable and flexible seat portion 36 supporting the body of a person sitting on the chair 10. Each end of the length or sheet 34 of pliable material is adjustably and removably anchored to the lateral members 24 and 32 of each frame 14 or 16 in the manner best illustrated at FIG. 2. The end edge, identified by reference numeral 38, and the end portion 40 of the length 34 of pliable material are first passed over the top of the parallel lateral cross-members 24 and 32 and below the cross-members, passed through the space between the cross-members such as to cause the end portion 40 to be wrapped partially around the periphery of the inner cross-member 32 such as to be once again passed below and wrapped partially around the periphery of the outer cross-member 24. The excess of the end portion 40 is thus tucked under the main portion of the length of sheet 34 of pliable material such that, when a traction is exerted in the direction of the arrow 42, as a result of a person sitting on the top of the length or sheet 34 of pliable material, each end portion 40 of length 34 of pliable material is securedly anchored to the lateral cross-members 24 and 32 as a result of frictional action between the diverse superimposed plies of pliable material at its end portions 40, including the friction between the surface of the pliable material and the peripheral surface of the lateral cross-members where they are wrapped around the parallel lateral cross-members 24 and 32. If the material stretches, and increases in length through usage, pulling on the ends or flaps 40 results in reestablishing tautness to the seat portion 36.

Figure 10:
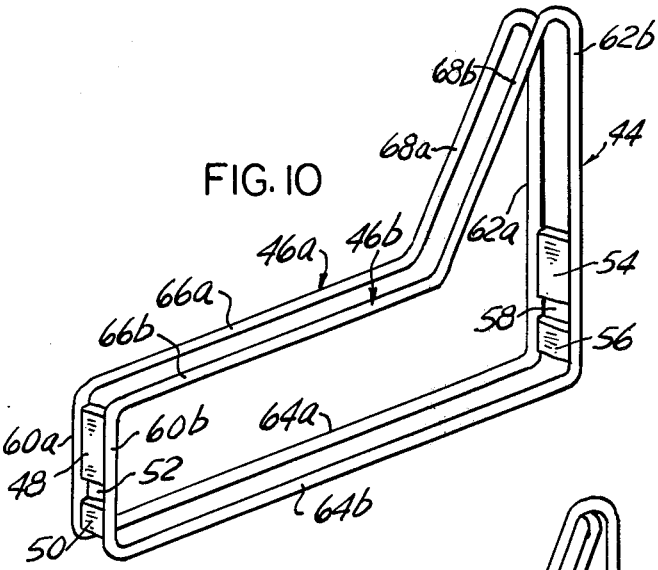
FIG. 10 is a perspective view of the frame structure for the armrest and back supporting portion thereof.

Referring now to FIGS. 3–5, there is illustrated a foldable chair 12, according to the present invention, which is generally of the type usually referred to as a "director's chair" or a "captain's chair". The chair 12 also comprises a pair of support frames 14 and 16 disposed such as to cross each other and be hingedly pivotable one relative to the other as hereinbefore described. Each of the frames 14 and 16 is provided with a single lateral cross-member 24 which, rather than supporting the seat portion 36, as in the back-less stool-like chair 10 if FIG. 1 is arranged to support one of a pair of laterally disposed armrests 44 which, in turn, support a length 46 of canvas, fabric, leather or plastic material defining a preferably inclined flexible back 48 supporting the back of a person sitting in the chair 12. Each armrest 44, as best shown in detail at FIG. 10, is made of a pair of parallely disposed frames **46*a* and 46*b* each formed of a closed loop of metallic rod or tubing, such as iron, steel or aluminum rod or tubing, interconnected and held apart parallel to each other by separate tie blocks 48 and 50 disposed between and welded or brazed to the two front upstanding portions 60*a* and 60*b* of the frames 46*a* and 46*b* and leaving therebetween an aperture 52, and tie blocks 54 and 56 disposed between and welded or brazed to the two upstanding rear portions 62*a* and 62*b* of the armrest frames 46*a* and 46*b*, and leaving therebetween an aperture 58. In addition to the pair of parallel relatively short upstanding portions 60*a* and 60*b* between which are fastened the tie blocks 48 and 50, and the pair of generally upright rear portions 62*a* and 62*b* between which are fastened the rear tie blocks 54 and 56, each armrest 44 consists of a pair of lower parallel cross-members 64*a* and 64*b*, a pair of parallel upper cross-members 66*a* and 66*b*, and a pair of inclined parallel back support cross-members 68*a* and 68*b* which, as best shown at FIGS. 3–5, provide a support and anchoring means for the ends of the length 46 of pliable material forming the back portion 48 of the chair 12**.

Figure 8:
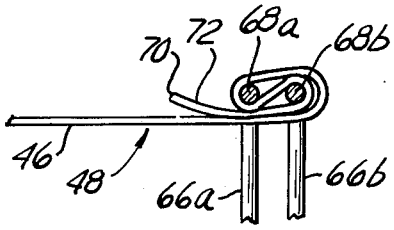
FIG. 8 is a partial sectional view thereof along line 8—8 of FIG. 3.

As shown in detail at FIG. 8, the end portion 72, provided with an edge 70, of the length 46 of pliable material forming the back portion 48 is wrapped over, around and between the back support cross-members **68*a* and 68*b* in the same manner as previously explained relative to the seat portion 36 of the stool-like chair 10, with the result that a pull on the end portion or flap 72 stretches the length of material 46 taut, and removal and replacement of the length of material 46** may be effected with ease when so desired.

The armrest 44, FIGS. 3–5 and 7, are hingedly attached to the support frames 14 and 16 as a result of the lateral cross-member 24 of each frame being passed through the aligned apertures 52 and 58 between the tie blocks 48 and 50 and 54 and 56, respectively. During manufacture of the chair 12, the assembly of the support frame 14 and 16 to the armrests 44 is effected prior to soldering, welding, brazing or otherwise fastening in position the lower tie blocks 50 and 56. The pliable material 34 forming the seat 36 of the chair is attached to the armrest lower cross-members **64*a* and 64*b*, FIG. 7, by passing the end portion 40 thereof over, under and between the two cross-members, with the result that the underlying end portion or flap 40 is held in position by frictional engagement, as previously explained. The pull, represented by the arrow 40, exerted on the length 34 of the material forming the seat 36 tends to pivot the armrests 44 around the pivot line represented by the support frame cross-members 24 disposed through the apertures 52 and 58 in such manner that the top of the armrest upright members 62*a* and 62*b* and angled members 68*a* and 68*b*, to which is attached the ends of the length 46 of pliable material forming the back 48, are urged away from each other, thus adequately tensioning the length 46 of pliable material forming the back 48 of the seat. A pin 74, FIGS. 5 and 7, may be disposed projecting rearwardly from the armrest upright member 62*a* such as to engage the rear leg member 20 of each of the frames 14 and 16 such that the weight of a person sitting in the seat 46 of the chair 12 assists in pivoting the armrests 44 away from each other at their position situated above the pivot line represented by the frame lateral cross-members 24 passed through the apertures 52 and 58. It will be appreciated that the lateral cross-members 24 may be soldered, welded, brazed or otherwise fastened to the tie blocks 48, 50, 54 and 56 and to the upright members 60*a*, 60*b*, 62*a* and 62*b* of the armrests 44**, where the respective surfaces of the element are in engagement, if so desired, resulting, however, in interferring with the complete folding of the chair to a substantially flat structure for ease of carrying.

As illustrated in FIG. 9, which represents the chair 12 in the process of being folded, the chair of the invention can easily be folded substantially flat for storage or transportation.

Figure 12:
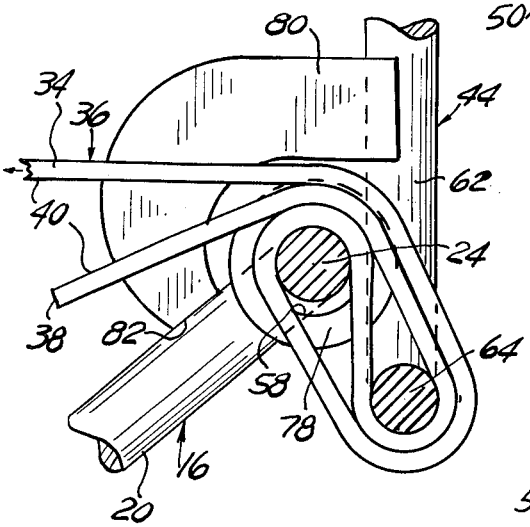
FIG. 12 is a view similar to FIG. 7 but showing a modification thereof.
Figure 11:
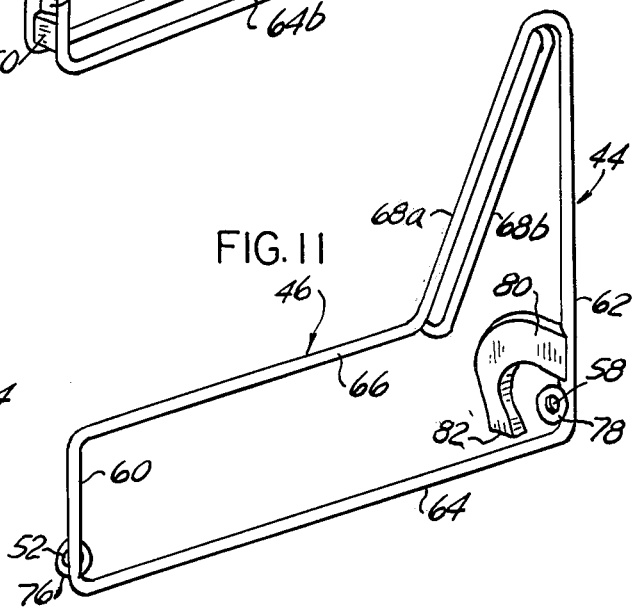
FIG. 11 is a view similar to FIG. 10 but showing a modification thereof.

The structure of the armrests 44 may be modified, as illustrated at FIG. 11, such that it consists of a single loop 46 or rod or tubular material forming an upright front portion 60 and a spaced apart substantially parallel rear portion 62 interconnected at the bottom by a single lower cross-member 64 and connected at the top by a single upper elbow-engaging cross-member 66 substantially parallel to the lower cross-member 64, the upper cross-member 66 being upwardly bent proximate an end to form an inclined back support members **68*a*, the second inclined back support member 68*b* being formed by a length of rod or tubing material welded, brazed or otherwise fastened at its bent-over ends respectively to the lower portion of the inclined back support member 68***a* and to the top thereof. A ring 76 is welded, soldered, brazed or otherwise fastened to the upright member 60 proximate the lower cross-member 64, and another ring 78 is similarly fastened to the rear upright member 62, the apertures 52 and 58, respectively, in the ring 76 and in the ring 78 providing a pivotal attachment of the support frames 14 and 16 by passage through the apertures of the frame lateral cross-member 24, FIG. 12. The lateral edge of the length of material 34 forming the seat 36 of the chair is attached to both the support frame lateral cross-member 24 and the armrest lower cross-member 64 by being passed over, under and between the two cross-members, in the same manner as previously explained. As a pull exerted in the direction of the arrow 40, resulting from the weight of a person sitting on the seat portion 36, results in swinging the armrests 44 of FIGS. 11–12 toward each other, the support frame lateral members 24 are either welded, brazed or otherwise fastened to the inner surface of the apertures 58 and 52 in the rings 78 and 76 or, alternatively, a generally C-shaped bracket 80 is welded, brazed or otherwise fastened at one end to the armrest rear upright member 62 and has a free end 82 engageable with the surface of the leg member 20 of each support frame 14 or 16 when the chair is unfolded and erected, with the result that the armrests 44 are prevented from pivoting toward each other.

Having thus described the present invention by means of structural embodiments thereof, modification whereof will be apparent to those skilled in the art, what is claimed as new is as follows:

1. A foldable chair comprising a pair of substantially rectangular similar support frames disposed such that the plane of one of said support frames intersects the plane of the other of said support frames in the form of a figure X as viewed from the front, pivot means enabling one of said support frames to pivot relative to the other at the line of intersection of said support frames, each of said support frames being made of a single piece of rod material defining a front leg, a rear leg disposed substantially parallel to said front leg, a longitudinally extending foot cross-member disposed substantially parallel to said pivot line and a first lateral cross-member disposed substantially parallel to said longitudinal foot cross-member, at least one second lateral cross-member attached to said support frame in close proximity to said first lateral cross-member substantially parallel thereto, and a single length of pliable material forming a seat portion for a person sitting in said chair, said length of pliable material having each lateral edge portion frictionally attached to at least said second lateral cross-members, wherein said pivot means are a pair of longitudinal rods disposed parallel to said cross-members and each attached to a single one of said support frames and having a portion at each end projecting beyond the front and rear legs of said single one of said support frames, said end portions abutting respectively against the front leg and the rear leg of the other of said support frames.

2. The chair of claim 1 wherein said first and second lateral cross-members are formed integral with each of said frames and each end of said length of flexible material comprises an edge portion wrapped around both said lateral cross-members of each pair in a first direction, wrapped around the innermost of said cross-members in said first direction and around the outermost of said cross-member in an opposite direction, and tucked under between the wrap around the innermost of said cross-members and the lower surface of said length of material forming said seat portion.

3. The chair of claim 1 further comprising a pair of side armrests each pivotally connected to one of said support frames and each provided with at least said second lateral cross-member of a pair forming the attachment means for the length of pliable material forming said seat portion, each of said side armrests having at an end a pair of closely spaced parallel and generally uprightly disposed members, and a back portion for supporting the back of a person sitting on said seat portion, said back portion comprising a single length of pliable material having each end frictionally attached to each pair of closely spaced parallel and generally uprightly disposed members.

4. The chair of claim 3 wherein each of said armrests comprises a third lateral cross-member, said second and third lateral cross-members defining the pair forming the attachment means for said seat portion, and each said first lateral cross-member is pivotally attached to one of said armrests.

5. The chair of claim 3 wherein said back portion length of pliable material has an edge portion at each end wrapped around both said generally uprightly disposed members of each pair in a first direction and around the outermost of said members in an opposite direction, and tucked under between the wrap around the innermost of the members and the rear surface of said length of material forming said back portion.

* * * * *